US008786202B2

(12) United States Patent
Kim

(10) Patent No.: US 8,786,202 B2
(45) Date of Patent: Jul. 22, 2014

(54) LIGHTING DEVICE AND METHOD OF CONTROLLING LIGHT EMITTED THEREBY

(75) Inventor: Namjin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 118 days.

(21) Appl. No.: 13/429,690

(22) Filed: Mar. 26, 2012

(65) Prior Publication Data

US 2013/0049615 A1 Feb. 28, 2013

(30) Foreign Application Priority Data

Aug. 25, 2011 (KR) ..... 10-2011-0084896

(51) Int. Cl.
*H05B 37/00* (2006.01)
*H05B 39/00* (2006.01)
*H05B 41/00* (2006.01)

(52) U.S. Cl.
USPC ..... 315/191; 315/192; 315/193; 315/294; 315/297

(58) Field of Classification Search
None
See application file for complete search history.

(56) References Cited

U.S. PATENT DOCUMENTS 7,009,580 B2 * 3/2006 Leung ..... 345/46
2011/0084619 A1 * 4/2011 Gray et al. ..... 315/185 R
2013/0015773 A1 * 1/2013 Tai et al. ..... 315/186

FOREIGN PATENT DOCUMENTS

KR 10-2009-0048100 A 5/2009
KR 10-2009-0065848 A 6/2009
KR 10-2010-0132840 A 12/2010
KR 10-2011-0072692 A 6/2011

OTHER PUBLICATIONS

Korean Notice of Allowance dated Aug. 19, 2013 issued in Application No. 10-2011-0084896 (with English translation).

* cited by examiner

*Primary Examiner* — Ahn Tran
(74) *Attorney, Agent, or Firm* — Ked & Associates, LLP

(57) ABSTRACT

A lighting device and a method of controlling a light emitted thereby are disclosed. A lighting device according to the present invention includes a rectifier unit configured to rectify an alternation current voltage to supply the rectified voltage to each of light emitting units, the light emitting units configured of a plurality of light emitting diodes connected with each other in series, a control unit configured to control each light emitting unit and a first switching element based on the input voltage and the first switching element configured to be switched on and off based on the control of the control unit, wherein the control unit controls to the first switching element switch on and off based on the input voltage to connect the first light emitting unit and the second light emitting unit alternatively in series and parallel.

17 Claims, 12 Drawing Sheets

LIGHTING DEVICE AND METHOD OF CONTROLLING LIGHT EMITTED THEREBY

CROSS-REFERENCE TO RELATED APPLICATION

This application claims priority under 35 U.S.C. §119 from Korean Application No. 10-2011-0084896 filed on Aug. 25, 2011, the subject matter of which is incorporated herein by reference.

BACKGROUND

1. Field

Embodiments may relate to a lighting device, more particularly, to a lighting device including light emitting units configured of a plurality of light emitting diodes connected in series and a method of controlling a light emitted from the lighting device not to have an increasing light velocity abnormally or a reversed light velocity, during a dimming process.

2. Background

In the lighting industry, studies and researches have been still under development on a lighting source, a light emission type and a driving method of a lighting apparatus.

A conventional lighting system generally uses a lighting source such as an incandescent lamp, an electric discharge lamp and a fluorescent lamp for a household, landscape and industrial usage. Here, a resistive lighting source including the incandescent lamp has a low efficiency and a heat generation problem. The electric discharge lamp has problems of a high price and a high voltage. The fluorescent lamp has an environmental disadvantage of mercury usage.

To overcome disadvantages of those lighting sources, there have been increasing interests in a light emitting diode (LED) having advantages of light-emitting efficiency, color variety and design autonomy. There have been increasing studies and researches on a lighting system including the LED as lighting source. The LED is a semiconductor element which emits a light when a voltage is applied thereto forwardly. The LED has a long usage life, low power consumption, with electrical, optical and physical properties which are proper to mass production and the LED has been rapidly replacing the incandescent lamps and fluorescent lamps.

In the meanwhile, lighting apparatuses such as a large amount of light emitting diodes or sensors are required in a building and a plant requires a large building such as. Also, a lighting system for managing and controlling such lighting apparatuses is required.

SUMMARY

Accordingly, the embodiments may be directed to a lighting device and a method of controlling a light emitted thereby. To solve the problems, an object of the embodiments may be to provide a lighting device a method of controlling a light emitted by a lighting device including a plurality of light emitting units configured of a plurality of light emitting diodes connected in series, not to increase a light velocity unnaturally during a dimming process or not to reverse the light velocity.

To achieve these objects and other advantages and in accordance with the purpose of the embodiments, as embodied and broadly described herein, a lighting device according to the present invention includes a rectifier unit configured to rectify an alternation current voltage to supply the rectified voltage to each of light emitting units, the light emitting units configured of a plurality of light emitting diodes connected with each other in series, a control unit configured to control each light emitting unit and a first switching element based on the input voltage and a first switching element configured to be switched on and off based on the control of the control unit, wherein the control unit controls to the first switching element switch on and off based on the input voltage to connect the first light emitting unit and the second light emitting unit alternatively in series and parallel.

Also, a method of controlling a light emitted from a lighting device including a plurality of light emitting units configured of light emitting diodes connected in series, includes rectifying an alternation current voltage input and supplying the rectified voltage to each of the light emitting units at a rectifier unit and controlling change in the velocity of the light emitted based on the input rectified voltage not to have discontinuity or not to be reversed at a control unit, wherein the step of controlling change in the velocity of the light emitted is performed the parallel and serial connection between the first and second light emitting units alternated based on the input voltage.

The present invention may have following advantages. First, reverse of a light velocity may be prevented which might be generated according to an input voltage. Because of that, a power factor, efficiency, dimming performance of the lighting device may be enhanced.

Second, the present invention may configurate and form a circuit may simply via an auxiliary cell. Because of that, the rising cost may be minimized.

It is to be understood that both the foregoing general description and the following detailed description of the embodiments or arrangements are exemplary and explanatory and are intended to provide further explanation of the embodiments as claimed.

BRIEF DESCRIPTION OF THE DRAWINGS

Arrangements and embodiments may be described in detail with reference to the following drawings in which like reference numerals refer to like elements and wherein.

DETAILED DESCRIPTION

Figure 1:
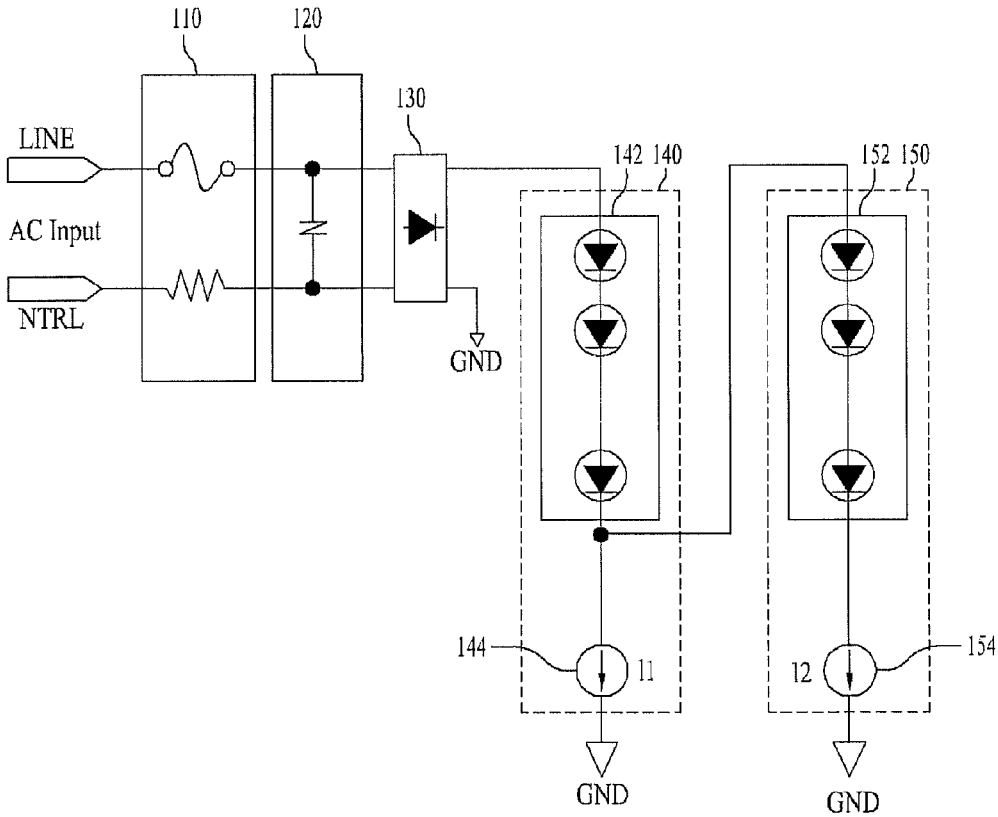
FIG. 1 is a block view illustrating a lighting device according to an embodiment.

As follows, a lighting apparatus according to an exemplary embodiment of the present invention and a method of emitting a light using the same will be described in reference to the accompanying drawings. Reference will now be made in detail to the specific embodiments of the present invention, examples of which are illustrated in the accompanying drawings.

Wherever possible, the same reference numbers will be used throughout the drawings to refer to the same or like parts and repeated description will be omitted. The size and appearance of each component shown in the drawings may be exaggerated or diminished for convenient explanation.

Terminology including ordinal numbers such as 'first' and 'second' may be used in describing a variety of components and the components are not limited by the terminological expressions and the terminological expressions are used only for distinguish one of the components from the others.

FIG. 1 is a block view illustrating a lighting device according to an embodiment.

As shown in FIG. 1, the lighting device may include a rectifier unit and a light emitting unit 140 and 150.

The rectifier unit may rectify an alternation current voltage inputted thereto and it may supply the rectified voltage to the light emitting units 140 and 150. The rectifier unit may include a protection circuit 110 and a surge protection circuit 130. The alternation current voltage may be a commercial electricity, for example.

FIG. 1 illustrates two light emitting units 140 and 150 connected with the rectifier unit.

Here, each of the light emitting units may include a single light emitting group and a current source.

Alternatively, each of the light emitting group may include a plurality of light emitting diodes connected in series. In other words, the first light emitting group 142 may be connected with the second light emitting group 152 in series.

As follows will be described in detail an overall operation of the lighting device shown in FIG. 1, especially, on/off of the light emitting diodes provided in each of the light emitting groups 142 and 152 based on the input voltage rectified in the rectifier unit.

Figure 2:
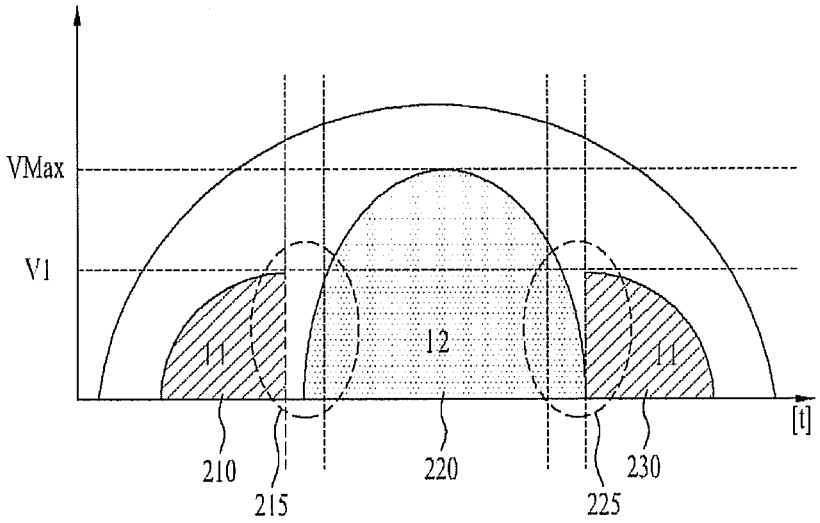
FIG. 2 is a diagram illustrating a method of emitting a light from the lighting device shown in FIG. 1.
Figure 3:
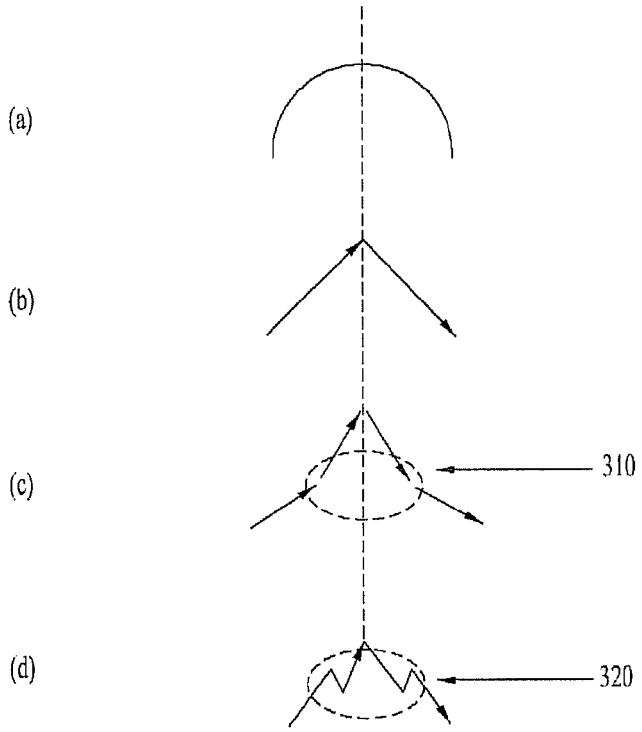
FIG. 3 is a diagram illustrating an example of change in a light velocity according to FIG. 2 and Table 1.

FIG. 2 is a diagram illustrating a light emitting method of the lighting device shown in FIG. 1. FIG. 3 is a diagram illustrating an example of light velocity change according to FIG. 2 and Table 1.

In reference to FIG. 2, a horizontal axis may refer to a time axis ([t]) and a vertical axis may refer to a voltage level or quantity ([v]).

Here, a semicircle-shaped curve with respect to the time axis [t] represents change of the voltage input after rectified in the rectifier unit mentioned above as shown in FIG. 3(*a*).

FIG. 2 shows largely three periods with respect to the horizontal axis, that is, the time axis based on the input voltage and largely two periods with respect to the vertical axis.

For example, in case of the former, that is, in case of with respect to the horizontal axis, there may be three periods including periods 210 and 230 in which only the first light emitting group 142 is switched on and a period in which only the second light emitting group 152 is switched on, based on the input voltage. At this time, gaps 215 and 225 may be located between each of the periods having only the first light emitting group 142 being on and the period having only the second light emitting group 152 being on. In other words, at a moment when the first light emitting group 142 is off after on in the period 210 where only the first light emitting group 142 is on, the second light emitting group 152 is on in a preset time period after the first light emitting unit is off, not when immediately the period in which only the second light emitting unit is on starts.

In contrast, the first light emitting group 142 may not be on immediately when the second light emitting group 152 is off after on in the period 220, in which only the second light emitting group 152 is on, but it may be on in a time period after when the period 230 in which only the first light emitting group 142 is one starts.

However, in case of the latter, that is, with respect to the vertical axis, there may be two periods including periods 210 and 230 to V1 level and a period 220 to V2 level, based on the input voltage. Here, when reaching V1 level, the first light group 142 may be on and off, regardless of on and off of the second light emitting group 152. Because of that, the second light emitting group 152 may not be on yet, even when the first light emitting group 142 is off after reaching V1 level as shown in the drawings.

Table 1 illustrates the latter method mentioned above, for example, the method shown in FIG. 2.

TABLE 1

| | Level | |
|---|---|---|
| | 0~V1 | V1~Vmax |
| CS1 | I1_Level1 | OFF |
| CS2 | OFF | I2_level1 |

As shown in Table 1, until V1 level (0~V1), a current source (CS1) 144 connected with the first light emitting group 142 may be switched on and a current source (CS2) 154 connected with the second light emitting group 152 may be switched off.

In contrast, until V2 level (V~Vmax), only the current source (SC2) 154 connected with the second light emitting group 152 may be switched on and the current source (CS1) 144 connected with the first light emitting group 142 may be switched off.

V1 and Vmax may be a reference value randomly determined with respect to a value of the voltage input after rectified in the rectifier unit provided in the lighting device. Vmax may be not a maximum value of the input voltage. Also, a range of voltage levels covered by V1 level may be in symmetry with a rage of voltage levels covered by V2 level or not.

In reference to FIG. 3, change in the input voltages, the number of the switched-on light emitting diodes and the light velocity may be compared in FIG. 2 and Table 1.

First of all, FIG. 3(*a*) illustrates change in the input voltages. Considering flow of the time from left to right, the input voltage is increased gradually and decreased, passing its zenith as shown in FIG. 2.

FIG. 3(*b*) illustrates change in the number of the light emitting diodes switched-on according to the change of the input voltage. In reference to FIG. 3(*b*), the number of the light emitting diodes switched on according to the input voltage is constantly increased and gradually decreased when the input voltage is decreased. For example, the number of the light emitting diodes may be in proportion to the input voltage of FIG. 3(*a*).

FIG. 3(*c*) illustrates an example of change in the light velocity in the lighting device according to the change of the input voltage shown in FIG. 3(*a*). Here, in reference to FIG. 3(*c*), the change of the light velocity may not necessarily be in proportion to the change in the input voltage shown in FIG. 3(*a*) or the change in the number of the switched-on light emitting diodes shown in FIG. 3(*b*). In other words, even when the input voltages and the number of the switched-on light emitting diodes are increased continuously, a non-linear area 310, that is, a discontinuity-point may be generated in the change in the velocity of light. Here, that non-linear point 310 may mean that the lighting device is drastically brighter or darker at a specific point, not that the lighting device is gradually brighter or darker. This phenomenon might create the user's anxiety that the lighting device is abnormal.

FIG. 3(*d*) illustrates another example of change in the velocity of the light in the lighting device according to the change in the input voltage. Here, in reference to FIG. 3(*c*), the change in the velocity of light may not be in proportion to the input voltage shown in FIG. 3(*a*) or the change in the number of the switched-on light emitting diodes necessarily. In other words, even when the input voltages and the number of the switched-on light emitting diodes are increased continuously, the discontinuity-point 320 may be generated in the change of the light velocity. Here, the discontinuity light velocity change point 320 may be generated in the light velocity change. Here, the discontinuity light velocity change point 320 may refer to the point at which the light velocity change is increased unnaturally or the light velocity change is reversed during the dimming process of the lighting device, for example.

In reference to FIG. 2 and Table 1, this is because the light velocity fails to be compensated by the off of the first light emitting group 142 which happens before the light velocity is changed linearly by the switched-on second light emitting group 152, for example. A first point 215 and a second point 225 shown in FIG. 2 show the reason.

The light velocity change may create the user's anxiety that the lighting apparatus is temporarily darker after flickering or bright or temporarily brighter after darker.

Figure 4:
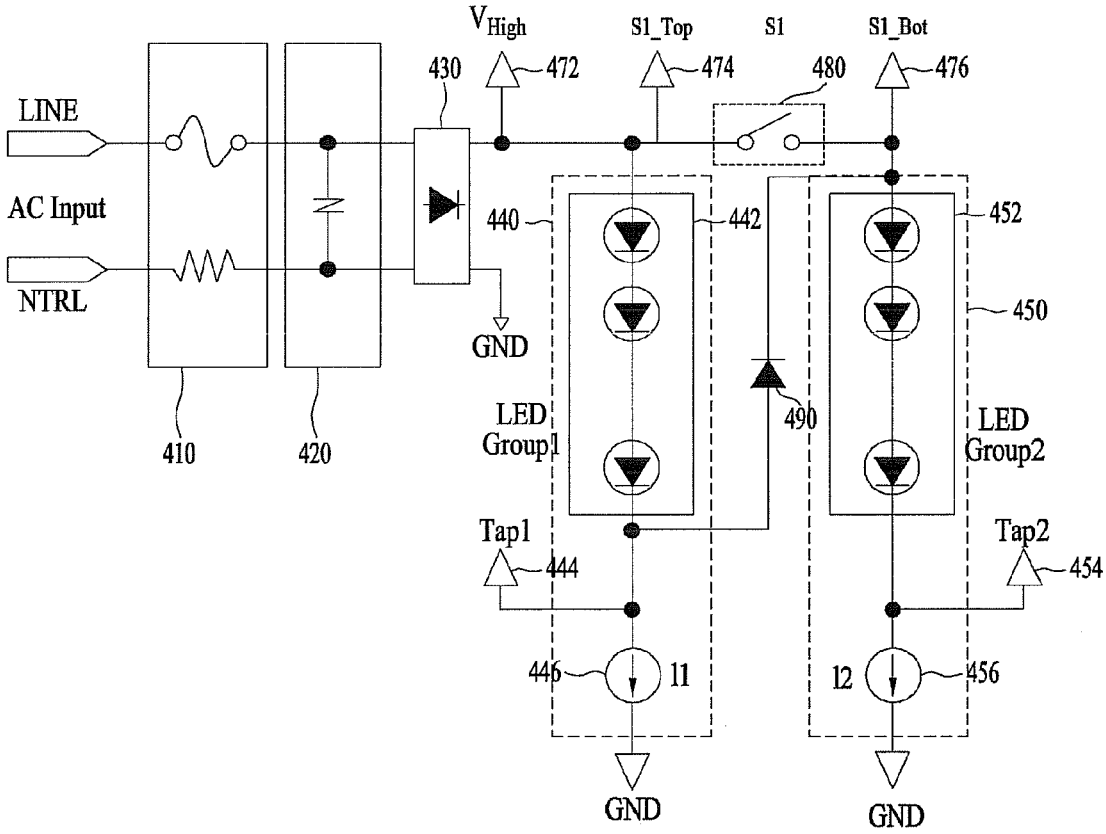
FIG. 4 is a block view illustrating a lighting device according to another embodiment.

FIG. 4 is a block view illustrating a lighting device according to another embodiment.

In reference to FIG. 4, a lighting device includes a may include a rectifier unit configured to rectify an alternation current voltage to supply the rectified voltage to each of the light emitting units, light emitting units configured of a plurality of light emitting diodes connected with each other in series, a control unit (not shown) configured to control each light emitting unit and a first switching element based on the input voltage, and light emitting units 440, and a first switching element that is switched on and off based on the control of the control unit. At this time, the control unit according to the embodiment may switch on and off the first switching element based on the input voltage to connect the first light emitting unit and the second light emitting unit alternatively in series and parallel.

In the meanwhile, the control unit may switch on the first switching element and switch off the parallel connection between the first and second light emitting units to connect the first and second light emitting units with each other in series. Also, a second switching element may be connected between the first and second light emitting units in series.

The second switching element may be switched on only when the first switching element is off and it may prevent current reverse toward the first light emitting unit from the second light emitting unit.

Also, each of the light emitting units may include a current source connected with the light emitting diodes to control currents and connection control means configured to connect and disconnect the light emitting diodes with and from the current source.

The control unit may on and off of control the first switching element and the current sources based on the input voltage, not to generate discontinuity in change in the light velocity or to reverse the change in the light velocity.

The first light emitting unit may have a different number of first switching elements connected in series.

In the lighting device, the number of light emitting diodes switched on after a preset voltage is input may be uniformly fixed. When currents of the second light emitting unit and the second current source reach a sufficient voltage level, the control unit control all of the first switching element and the first current source provided in the first light emitting unit to be switched off, only to drive only the second current source.

In reference to FIG. 4, each of the configurations composing the lighting device will be described as follows.

The rectifier unit may rectify the alternation current voltage inputted thereto and it may supply the rectified voltage to a plurality of light emitting units 440 and 450. The rectifier unit may include a protection circuit 410, a surge protection circuit 420 and a rectifier circuit 430.

Different from FIG. 1 mentioned above, FIG. 4 illustrates two light emitting units 440 and 450 connected to rectifier end (VHIGH~GND). Here, the present invention may not be limited thereby. Alternatively, a first to a N light emitting unit ("N" is a natural number) may be further connected according to the same or similar connection as or to the connection of the first and second light emitting units 440 and 450. Here, "N" may not be a value with infinity necessarily and it may be a proper value determined in consideration of the input voltage in the lighting device and efficiency of the circuit. Here, FIG. 4 illustrates only two light emitting units to make the present invention understood, for convenience.

In reference to FIG. 4, the first light emitting unit 440 and the second light emitting unit 450 may be connected in series and parallel, for example. Here, according to the present invention, an auxiliary first switching element 480 may be located to connect the first and second light emitting units 440 and 450 in parallel and a second switching element 490 may be located to connect the first and second light emitting units 440 and 450 in series. The connection control means will be described in detail later.

For example, different from FIG. 1, each of the light emitting units may include a plurality of light emitting groups having a plurality of light emitting diodes connected with each other in series, connection control means 444 and 454 and current sources 446 and 456. For example, the first light emitting unit 440 may be configured of a first light emitting group 442, first connection control means 444 and a first current source (CS1) 446. The second light emitting unit 450 connected with the first light emitting unit 440 in series may be configured of a second light emitting group 452, second connection means 454 and a second current source (CS2) 456.

The control unit may basically perform a function of controlling on and off of each light emitting group 442 and 452 via the connection control means 444 and 454. Here, an algorithm and method of the control unit controlling the on and off of each light emitting unit according to the present invention will be described in detail in reference to FIG. 5 and Table 2, omitted herein.

The connection control means may be one of a middle tap, a switch and a diode. Here, for explanation convenience of the present specification, the first and second connection means 444 and 454 may use a middle tap and the first switching element 480 may be a switch and the second switching element 490 may be a diode for current reverse prevent. Especially, the first and second connection control means 444 and 454 may be located between the light emitting groups 442 and 452 and the current sources 446 and 456, respectively, to connect or disconnect them with each other based on change in the voltage or current and control of the control unit.

As follows will be described in detail in reference to FIG. 5 and Table 2 an overall operation of the lighting device including on and off of the light emitting diodes provided in the lighting device of FIG. 4, especially, in the light emitting groups 442 and 452 according to the voltage input after rectified in the rectifier unit.

Figure 5:
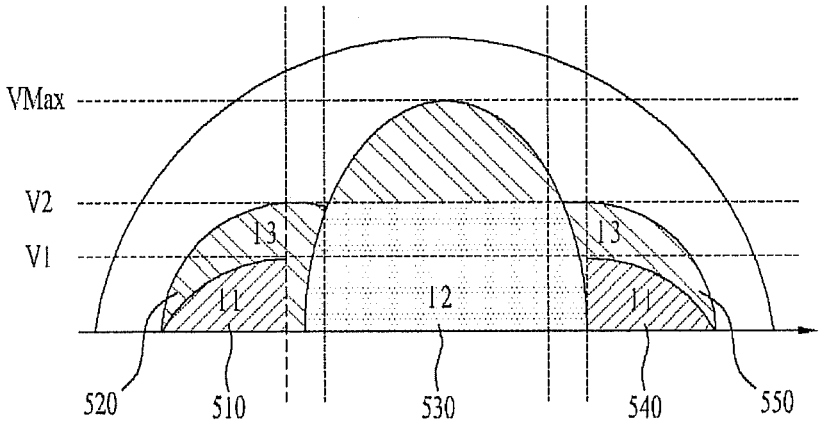
FIG. 5 is a diagram illustrating a method of emitting a light from the lighting device shown in FIG. 4.
Figure 6:
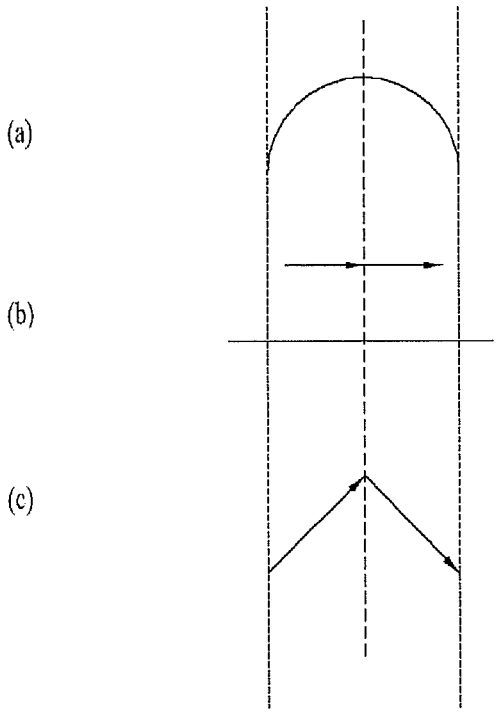
FIG. 6 is a diagram illustrating relation between the change in the light velocity and the number of switched-on light emitting diodes in the lighting device show in FIG. 4.

FIG. 5 is a diagram illustrating a light emitting method of the lighting device shown in FIG. 4. FIG. 6 is a diagram illustrating relation between the change in the light velocity and the number of the lighting diodes that are switched on.

Similar description of FIGS. 5 and 6 and Table 2 will be quoted from the description of FIGS. 2 and 3 and Table 1 and it will be omitted accordingly. Hereinafter, a different configuration will be described.

The control unit configured to control the on and off of the light emitting unit may basically control the light emitting units to be connected in parallel and series alternatively by using the switching element, based on the input voltage input via a rectifier unit end (VHIGH~GND). At this time, all of the light emitting diodes may be controlled to be always switched on and only the light velocity may be controlled to change based on the input voltage. Especially, the on and off of the light emitting groups 442 and 452 not to generate discontinuity point in the light velocity change of the lighting device or not to reverse the light velocity change.

Here, the control unit may control the on and off of a corresponding light emitting unit via the connection control means 444 ad 454 provided in the light emitting groups 442 and 452, respectively.

Here, the second light emitting unit 450 may include the same number or a different number of light emitting diodes connected with in series than the first light emitting unit 440.

According to the present invention, the light velocity change may be controlled not to be reversed and the number of the light emitting diodes switched on according to the input voltage may not be increased linearly because of that. For example, the number of the switched-on light emitting diodes in this case may be always fixed, regardless of the input voltage.

As follows, a control process for the on and off of the light emitting unit based on a voltage level in reference FIGS. 4 and 5 and Table 2 will be described.

Like the description of FIG. 2 mentioned above, a horizontal axis of FIG. 5 refers to a time axis and a vertical axis refers to a voltage level axis.

Here, in case of FIG. 5 different from FIG. 2, there are three voltage level references V1, V2 and Vmax in the vertical axis and three time periods in the horizontal axis, which is different from the meaning of FIG. 2.

For example, Table 1 illustrates each level and the on and off control of the light emitting unit with respect to the vertical axis of FIG. 5.

TABLE 2

| | Level | | |
|---|---|---|---|
| | V1 Level (0~V1) | V2 Level (V1~V2) | V3 Level (V2~VMax) |
| S1 | On | On | OFF |
| CS1 | I1_Level1 | I1_Level2 | OFF |
| CS2 | I2_Level1 | I2_Level2 | I2_Level2 |

For example, in reference to FIGS. 4 and 5 and Table 2, a method of controlling the light with respect to the vertical axis will be described as follows.

In V1 level (0~V1), the first switching element 480 may be switched on, based on the input voltage. As a result, the first light emitting unit 440 and the second light emitting unit 450 may be connected in parallel. A voltage of the rectifier end (VHIGH~GND) may be applied to the first light emitting unit 440 and the second light emitting unit 450 identically. At this time, the current quantity of the first current source 446 provided in the first light emitting unit and the current quantity of the second current source 456 provided in the second light emitting unit may be I1_LEVEL1 and I2_LEVEL1. Here, I1_LEVEL1 and I2_LEVEL1 may be the same or not. For example, they may be determined on the number of the light emitting diodes connected with the first light emitting group 442 in series.

In V2 level (V1~V2), the first switching element 480 may still maintain the on-status. Because of that, the first light emitting unit 440 and the second light emitting unit 450 may be still connected in parallel. The identical voltage of the rectifier end (VHIGH~GND) may be applied to the first light emitting unit 440 and the second light emitting unit 450. Also, the current quantity of the first current source 446 provided in the first light emitting unit and the current quantity of the second current source 456 provided in the second light emitting unit may be I1_LEVEL2 and I2_LEVEL2. Here, I1_LEVEL2 and I2_LEVEL2 may be the same or not, as mentioned above.

In the meanwhile, I1_LEVEL1 and I2_LEVEL1 in V1 level and I1_LEVEL2 and I2_LEVEL2 in V2 level may have different input voltages at corresponding levels, respectively, to have different values, respectively. In other words, as shown in FIG. 5, I1_LEVEL2 and I2_LEVEL2 in V2 level may have higher values than I1_LEVEL1 and I2_LEVEL1 in V1 level.

Lastly, in Vmax (V2~Vmax), the current quantity of the second current sources 456 may be increased enough, based on the input voltage, only to switch off the first switching element 480. Here, the first current source 446 is also switched off and the voltage applied from the rectifier end (VHIGH~GND) may be distributed in proportion to the first light emitting group 442 and the second light emitting group 452, to have a value of I2_LEVEL2 as shown in FIG. 5.

In Vmax level, when the first switching element 480 is switched off, in other words, opened, a switching element for current power factor prevention, that is, a diode 490 may be connected between the first and second light emitting groups 442 and 452 in series to prevent currents from reversed by voltage difference between S1_Top and S1_Bot point.

FIG. 6 illustrates change in the number of the switched-on light emitting diodes or change in the light velocity of the light emitting diodes. As shown in FIG. 6(*a*), when a voltage is applied via a rectifier unit end, and when a voltage sufficient to switch on each of the light emitting diodes initially as shown in FIG. 6(*b*), the first and second light emitting unit 440 and 450 may be connected in parallel based on a voltage level of the input voltage, to be changed into in series based on a voltage level of the input voltage. Because of that, the number of the switched-on light emitting diodes may be always the same. Here, as shown in FIG. 6(*c*), when the input voltage is low although the number of the switched-on light emitting diodes is fixed, the light velocity may be decreased. As the input voltage is getting higher, the light velocity may be increased gradually in proportion to the input voltage.

As result, in case of according to the present invention, when a preset voltage or more is applied in the lighting device, change in the light velocity the user feels may be increased gradually close to a linearity, without discontinuity or non-linear reverse of the light velocity although the number of the switched-on light emitting diodes based on the input voltage. This may mean that a dimming operation required by the user may be performed naturally and the emitted lights may be controlled, to give comfort to the user. Together with that, the linearity of the change in the light velocity may prevent the lighting device from flicking, getting darker after bright, different from FIGS. 1 to 3.

As follows, a detailed configuration of each component shown in FIG. 4 will be described.

Figure 7:
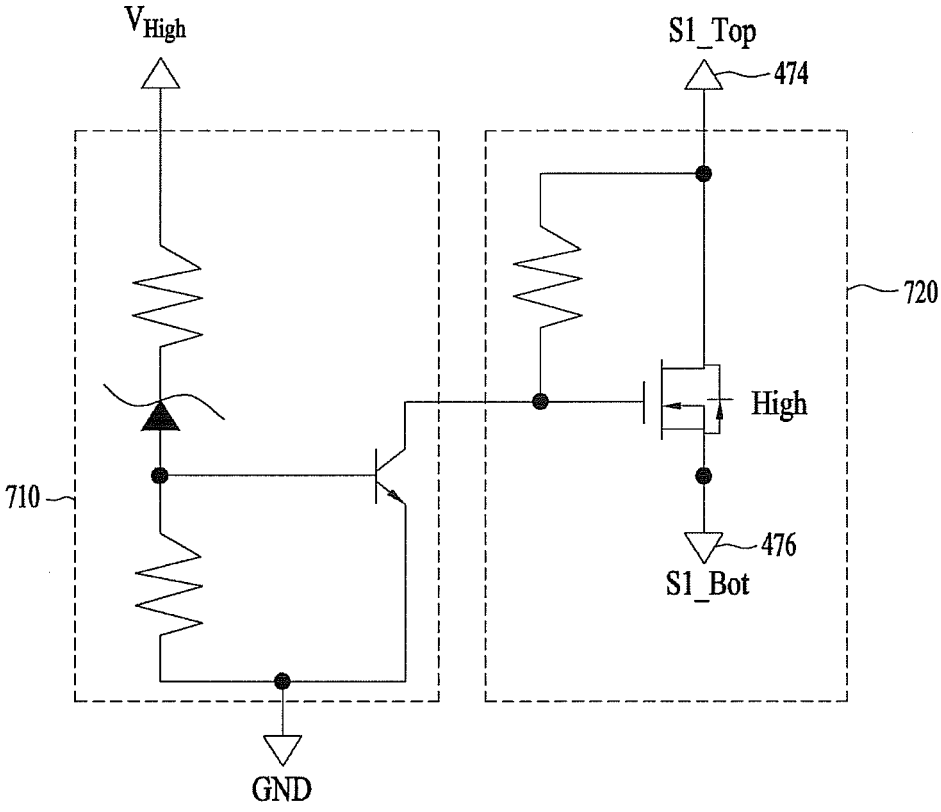
FIG. 7 is a block view illustrating an example of a detailed configuration of a switching element 480 shown in FIG. 4.

FIG. 7 is a block view illustrating an example of a detailed configuration possessed by the first switching element 480 shown in FIG. 4.

FIG. 4 illustrates a simple switch and however a detailed circuit configuration thereof is shown in FIG. 7.

In reference to FIG. 7, the detailed circuit configuration of the switching element 480 may mainly include two areas. A left area 710 may refer to a voltage level sensing circuit and a right area 720 may embody a switching circuit.

Here, the left area 710 may be configured of a resistance, a zener diode and an amplifier, to sense a voltage level. Input of the switching circuit located in the right area 720 may be controlled based on a level of the input voltage and on/off of the first switching element 480 may be determined.

Figure 8:
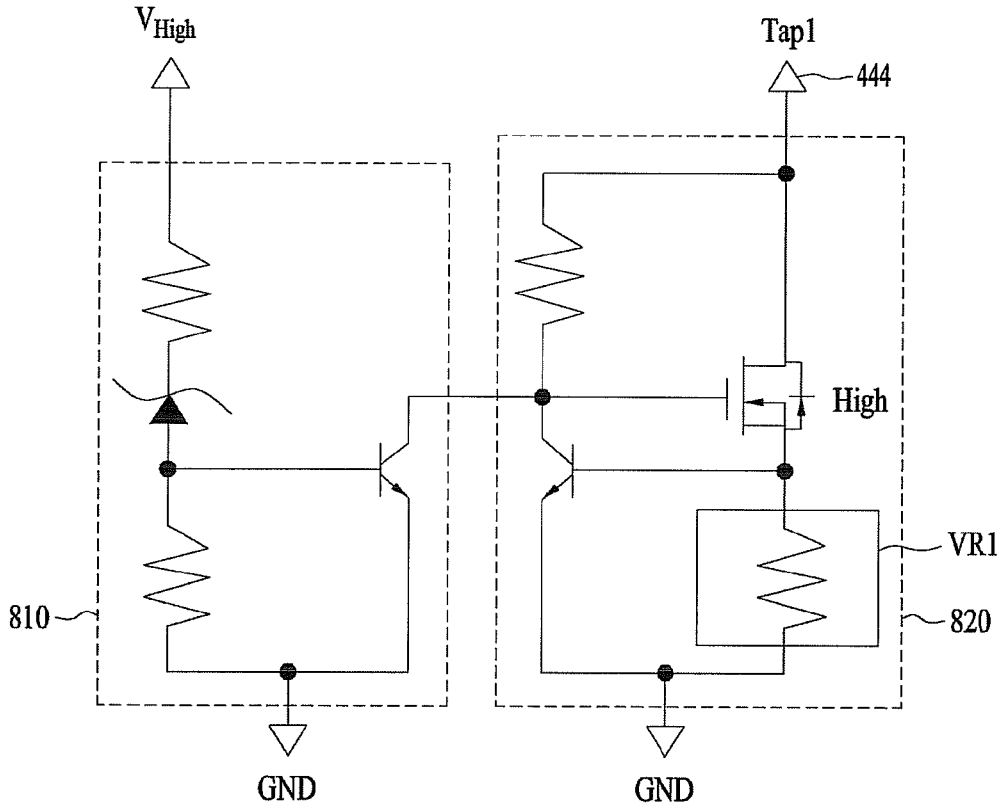
FIG. 8 is a block view illustrating an example of a detailed configuration of a first current source shown in FIG. 4.

FIG. 8 is a block view illustrating a detailed configuration of a first current source 446 shown in FIG. 4 according to an embodiment.

FIG. 8 illustrates a detailed circuit configuration of the first current source 446 provided in the first light emitting unit 440.

Such the first current source 446 may be a circuit configured to control a current input to the light emitting diode provided in the light emitting group, to control the light emitting diodes to be on and off. At this time, the current control circuit may include a feedback resistance to control the amount of currents input to amplifiers, for example.

Also, the currents input to the current control circuit may be controlled by the connection control means 444 according to the present invention. A level of such the input current may be re-controlled by the feedback resistance.

In the meanwhile, FIG. 8 illustrates a right voltage level sensing circuit 810 (the same circuit and the same function as the circuit and function of FIG. 7) as well as a right current source 820, in other words, between the connection control means 444 and a ground (GND).

For example, the voltage level sensing circuit may be located at a rear end of the rectifier circuit 430 provided in the rectifier unit shown in FIG. 4, that is, between terminals of VHIGH and the ground (GND).

Such the voltage level sensing circuit may sense a voltage level by controlling the resistance via a variable resistance, when the voltage rectified in the rectifier unit is input.

Figure 9:
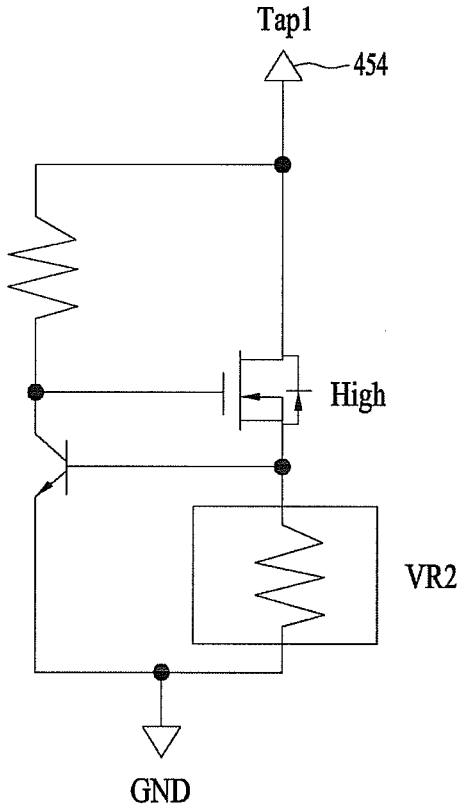
FIG. 9 is a block view illustrating an example of a detailed configuration of a second current source 442 shown in FIG. 4.

FIG. 9 is a block view illustrating an example of the detailed configuration possessed by the second current source 456 shown in FIG. 4.

Like FIG. 8, FIG. 9 illustrates a circuit configuration of the second current source 456 possessed by the second light emitting unit 450 shown in FIG. 4.

For example, such the second current source 456 may have the same circuit configuration as the right current control circuit shown in FIG. 8 and it may be controlled by the second connection control means 454. The description of the right area shown in FIG. 8 is quoted and the same detailed description will be omitted.

Figure 10:
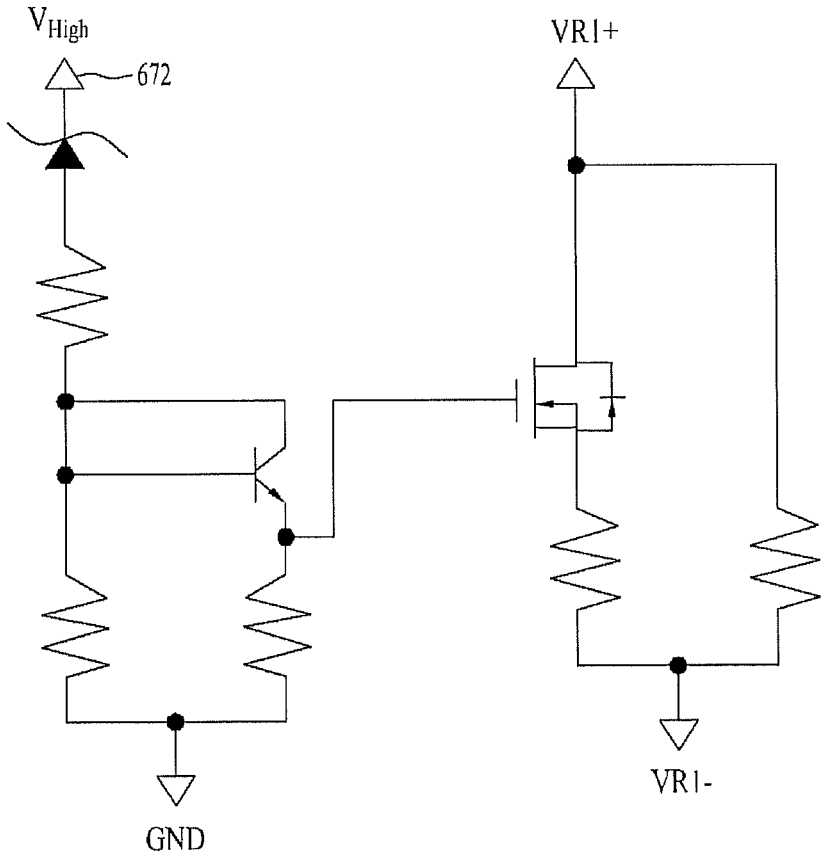
FIG. 10 is a block view illustrating an example of a detailed configuration a feedback resistance (VR1) shown in FIG. 8.

FIG. 10 is a block view illustrating an example of a detailed circuit of the feedback circuit resistance (VR1) shown in FIG. 8.

FIG. 10 illustrates a detailed circuit diagram of the feedback resistance (VR1) shown in FIG. 8. The feedback resistance (VR1) may be configured of a switching element and resistance elements to control a level for current control, for example.

In the meanwhile, a switching control circuit is provided in a right area in FIG. 10, relating to current control in the current control circuit. The switching control circuit may enable the current control performed based on the level.

Figure 11:
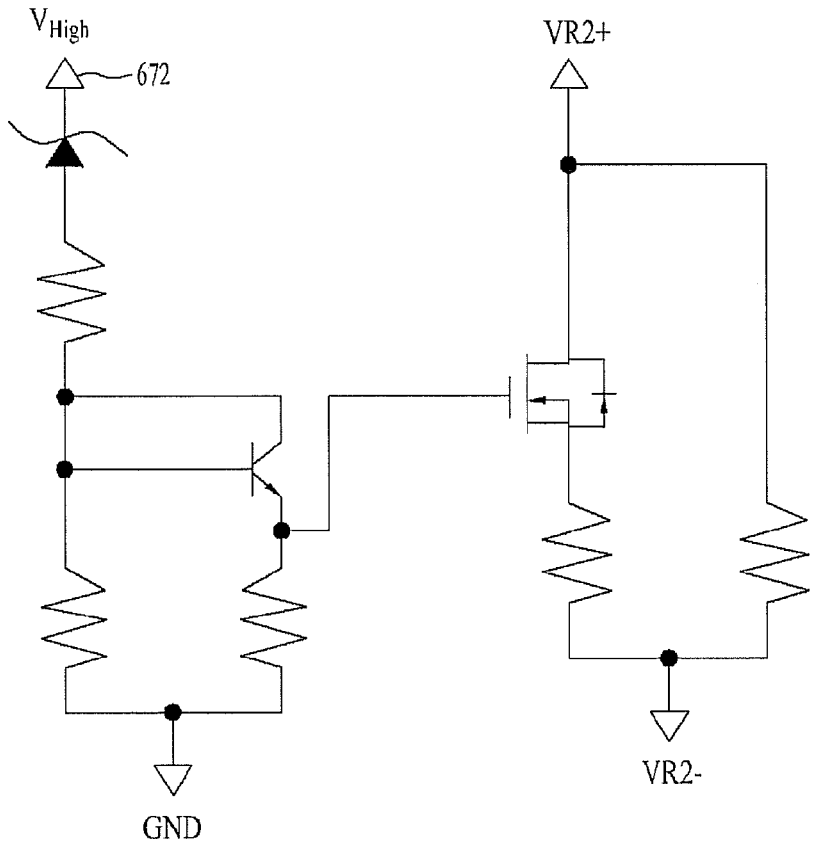
FIG. 11 is a block view illustrating an example of a detailed circuit configuration of a feedback resistance (VR2) shown in FIG. 9.

FIG. 11 is a block view illustrating an example of the detailed circuit configuration possessed by a feedback resistance (VR2) shown in FIG. 9. A right switching control area and a right feedback resistance shown in FIG. 11 may be the same as the circuit configuration shown in FIG. 10 mentioned above.

As a result, here, the detailed description thereof will be described and the above description may be quoted.

As mentioned above, the feedback resistances of FIGS. 10 and 11 may be connected with different light emitting units, respectively. A circuit element value of each circuit configuration may be different from each other.

Figure 12:
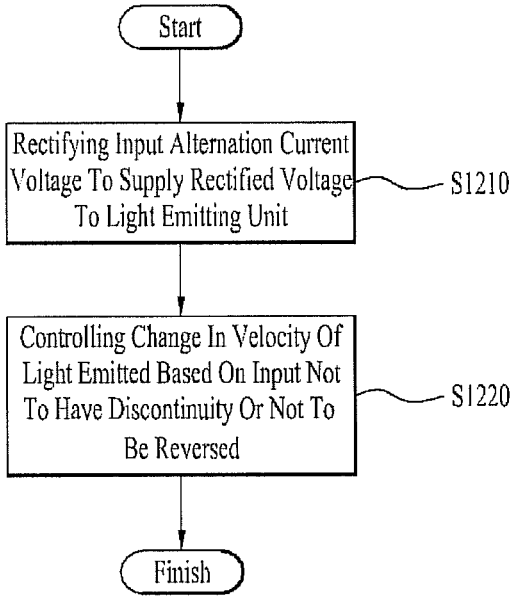
FIG. 12 is a flow chart illustrating a method of controlling a light emitted from the lighting device according to an embodiment.

FIG. 12 is a flow chart illustrating a method of controlling the light emitted from the lighting device according to an embodiment.

The method of controlling the light emitted from the lighting device including the plurality of the light emitting units configured of light emitting diodes connected in series according to the embodiment will be described as follows.

First of all, the rectifier unit may rectify an alternation current voltage input thereto and it may supply the rectified voltage to each of the light emitting units 440 and 450 (S1210).

The control unit may control change in the velocity of the light emitted based on the input rectified voltage not to have discontinuity or not to be reversed (S1220).

In the step of S1220 of the process shown in FIG. 12, the parallel and serial connection between the first and second light emitting units may be alternated based on the input voltage. In the step of S1220, when the input voltage is a preset voltage level or less, the first and second light emitting units may be controlled to be connected in parallel. When the input voltage is more than the preset level, the first and second light emitting units may be controlled to be connected in series.

Also, the switching element may be connected between the first and second light emitting units in series. The switching element may be switched on, only when the input voltage is more than the preset level and it may prevent current reverse from the second light emitting unit to the first light emitting unit.

In addition, each of the light emitting units may include the current course connected with the light emitting diodes to control the currents and connection control means configured to connect or disconnect the current source with or from the light emitting diodes.

In the meanwhile, in the step of S1220, the serial and parallel connection between the first and second light emitting units and the on or off of the current source may be controlled not to generate discontinuity in the change in the light velocity or not to reverse the change in the light velocity, based on the input voltage.

Here, the number of the light emitting diodes connected with the first light emitting unit in series may be different from the number of the light emitting diodes connected with the second light emitting units in series.

However, in the step of S1220, the number of the switched-on light emitting diodes may be uniform.

In the step of S1220, when the currents of the second current source provided in the second light emitting unit reaches a sufficient voltage level based on the input voltage, both of the first switching element and the first current source provided in the first light emitting unit may be switched off, to drive only the second current source.

Therefore, according to the present invention as mentioned above, the reverse of the light velocity based on the input voltage may be prevented. Because of that, a power factor, efficiency, dimming performance of the lighting device may be enhanced. Also, the circuit may be realized simply via an auxiliary cell and the rising cost may be minimized.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a rectifier unit configured to rectify an alternation current voltage to supply the rectified voltage to a plurality of light emitting units;

the light emitting units configured of a plurality of light emitting diodes (LEDs) connected with each other in series;

a plurality of current sources connected with each of the light emitting units to control currents inputted to a corresponding light emitting unit;

a control unit configured to control the plurality of current sources and a first switching element based on levels of an input voltage via the rectifier unit; and the first switching element configured to be switched on and off based on the control of the control unit, wherein the control unit controls the plurality of current sources and the first switching element based on the levels of the input voltage;

in a first voltage level, switching on the first switching element, controlling to saturate a first current level of the first current source, and controlling to saturate a first current level of the second current source, in a second voltage level, switching on the first switching element, controlling to saturate a second current level of the first current source, and controlling to saturate a second current level of the second current source, and in a third voltage level, switching off the first switching element, turning off the first current source, and controlling to maintain the second current level of the second current source.

2. The lighting device of claim 1, wherein the first light emitting unit and the second light emitting unit is in series or parallel to be switched the first switching element on or off based on the levels of the input voltage.

3. The lighting device of claim 2, further comprises a second switching element configured to be connected between the first and second light emitting units in series.

4. The lighting device of claim 3, wherein the second switching element is switched on only when the first switching element is off so as to prevent current reverse toward the first light emitting unit from the second light emitting unit.

5. The lighting device of claim 4, wherein each of the light emitting units includes connection control means configured to connect and disconnect the LEDs with and from the corresponding current source.

6. The lighting device of claim 5, wherein the control unit controls on and off of control the first switching element and the current sources based on the input voltage, not to generate discontinuity in change in the light velocity or to reverse the change in the light velocity.

7. The lighting device of claim 6, wherein a number of LED of the first light emitting unit is different from a number of LED of the second light emitting unit.

8. The lighting device of claim 7, wherein the lighting device is uniformly fixed in a number of LEDs switched on after a preset voltage is inputted.

9. The lighting device of claim 8, wherein When currents of the second light emitting unit and the second current source reach a sufficient voltage level, the control unit controls all of the first switching element and the first current source provided in the first light emitting unit to be switched off, only to drive only the second current source.

10. A method of controlling a light emitted from a lighting device including a plurality of light emitting units configured of light emitting diodes (LEDs) connected in series, the method comprising:

rectifying an alternation current voltage input and supplying the rectified voltage to each of the light emitting units at a rectifier unit; and controlling a plurality of current sources connected to the plurality of light emitting units and a first switching element located between a first light emitting unit and a second light emitting unit based on levels of an input voltage at a control unit, wherein the step of controlling change in the velocity of the light emitted is performed;

in a first voltage level, switching on the first switching element, controlling to saturate a first current level of the first current source, and controlling to saturate a first current level of the second current source, in a second voltage level, switching on the first switching element, controlling to saturate a second current level of the first current source, and controlling to saturate a second current level of the second current source, and in a third voltage level, switching off the first switching element, turning off the first current source, and controlling to maintain the second current level of the second current source.

11. The method of claim 10, wherein when the input voltage is a preset voltage level or less, first and second light emitting units are controlled to be connected in parallel and when the input voltage is more than the preset level, the first and second light emitting units are controlled to be connected in series.

12. The method of claim 11, wherein when the input voltage is more than the preset level only, the switching element is switched on so as to prevent current reverse from the second light emitting unit to the first light emitting unit.

13. The method of claim 12, wherein each of the light emitting units includes connection control means configured to connect or disconnect the current source with or from the LEDs.

14. The method of claim 13, wherein the serial and parallel connection between the first and second light emitting units and the on or off of the current source is controlled not to generate discontinuity in the change in the light velocity or not to reverse the change in the light velocity, based on the input voltage.

15. The method of claim 14, wherein a number of LED of the first light emitting unit is different from a number of LED of the second light emitting units.

16. The method of claim 15, wherein a number of the switched-on LEDs is uniform.

17. The method of claim 16, wherein when the currents of the second current source provided in the second light emitting unit reaches a sufficient voltage level based on the input voltage, both of the first switching element and the first current source provided in the first light emitting unit are switched off, to drive only the second current source.

* * * * *